United States Patent [19]

Renfro

[11] Patent Number: 4,671,359

[45] Date of Patent: Jun. 9, 1987

[54] APPARATUS AND METHOD FOR SOLIDS REMOVAL FROM WELLBORES

[75] Inventor: Jimmie J. Renfro, Plano, Tex.

[73] Assignee: Atlantic Richfield Company, Los Angeles, Calif.

[21] Appl. No.: 838,645

[22] Filed: Mar. 11, 1986

[51] Int. Cl.[4] ..... E21B 37/00

[52] U.S. Cl. ..... 166/312; 166/223; 175/67

[58] Field of Search ..... 166/312, 311, 56, 157, 166/223; 175/67

[56] References Cited

U.S. PATENT DOCUMENTS

| | | | |
|---|---|---|---|
| 2,120,132 | 6/1938 | Hawkins | 166/311 |
| 2,652,117 | 9/1953 | Arendt et al. | 166/312 |
| 3,007,526 | 11/1961 | Tausch | 166/312 |
| 3,020,958 | 2/1962 | Kennedy | 166/312 |
| 3,163,226 | 12/1964 | Lagucki | 166/312 |
| 3,722,594 | 3/1973 | Smith et al. | 166/311 |

*Primary Examiner*—Stephen J. Novosad
*Assistant Examiner*—Terry Lee Melius
*Attorney, Agent, or Firm*—Michael E. Martin

[57] ABSTRACT

A well cleanout system for removing accumulations of solid particles in a gravel pack screen or liner and in the vicinity of a casing or liner hanger includes a tubular extension member which may be lowered into the production fluid tubing string and secured to a nipple at the lower end of the tubing string. Coiled tubing with a nozzle arrangement on the distal end thereof is extended through the tubular extension member and into the wellbore for jetting a cleanout fluid into the wellbore to entrain solids in a fluid stream which is pumped to the surface through the production tubing. The coiled tubing, nozzle and extesnion member may be retrieved by unlocking the extension member and pulling the coiled tubing out of the wellbore.

11 Claims, 4 Drawing Figures

APPARATUS AND METHOD FOR SOLIDS REMOVAL FROM WELLBORES

BACKGROUND OF THE INVENTION

1. Field of the Invention

The present invention pertains to apparatus for insertion in a wellbore and a method associated therewith for removal of solids accumulations in and around a gravel pack screen and other areas where solids may collect and interfere with the production of well fluids.

2. Background

In fluid producing wells and mineral leaching operations, for example, various types of solid particles and sediments tend to accumulate in the wellbores at various locations. It is generally desireable to prevent the accumulation of solids or sediments in order to avoid the restriction to the flow of produced fluids which is caused by such materials. It is often necessary in oil and gas wells, for example, to perform cleanout operations to remove accumulations of solids in the wellbores in the vicinity of the fluid producing formation. Such solids tend to accumulate in the rathole portion of the wellbore, in and around gravel pack screens or liners, and in other areas of the wellbore, such as on the transverse shoulders or other portions of mechanisms comprising parts of liner hanger structures, packers and other wellbore devices.

Conventional well cleanout operations involve the insertion of a relatively small diameter tubing string generally concentrically through the production fluid tube or conduit and into the wellbore below the end of the production tube in an effort to remove any accumulations of solids by pumping a fluid through the small tube to generate enough turbulence and fluid flow velocity such that solids are hopefully entrained with the jetted fluid and carried upward through an annular flow passage formed between the production fluid tubing and the circulating fluid tube.

However, conventional arrangements of production fluid tubing and cleanout fluid injection apparatus fail to provide for efficient and complete removal of a major portion of the solids from the wellbore, particularly solids which tend to accumulate on transverse surfaces formed by various in-the-well devices. Conventional arrangements of well cleanout systems therefore usually do not provide for the complete cleanout of solids and these solids tend to fall back into the gravel pack screen or liner, thereby blocking a portion of the liner structure from permitting the flow of production fluids. Incomplete cleanout of solids or sediments also introduces the possibility of accumulation of sufficient amounts of solids in the wellbore such as to prevent insertion of cleanout or injection tubing, particularly if there is otherwise a stoppage of fluid circulation or a reduction in the circulation rate in the wellbore.

Accordingly, there has been an acute need for an improved arrangement and method of cleaning out wellbores to remove accumulated solids, particularly in wellbores which include an otherwise conventional arrangement of a gravel pack liner or screen disposed in the wellbore below the open end of a production fluid tube or the like. It is to this end that the present invention is directed wherein there is provided an improved arrangement of a well cleanout system and an improved method of performing well cleanout or solids removal operations without removal of a portion of the well structure and wherein a more complete and thorough removal of accumulated solids is accomplished.

SUMMARY OF THE INVENTION

The present invention provides an improved apparatus which is insertable in a wellbore for performing operations to remove solids which tend to accumulate in areas such as the flow passage formed within a gravel pack screen or liner and other areas of the wellbore wherein the accumulation of solids will eventually tend to block the flow of production fluids and tend to impede the insertion and removal of various devices with respect to the wellbore.

In accordance with one important aspect of the present invention, there is provided a wellbore solids cleanout apparatus for insertion in a conventional wellbore having a production fluid tube and an area below the production fluid tube which is susceptible to the accumulation of solids. The apparatus is characterized by means including an extension member of the production fluid tube and an elongated circuit which fits within the extension member and includes a nozzle arrangement on the distal end thereof whereby a circulating flow of fluid may be introduced into the wellbore in the vicinity of accumulated solids to entrain or wash the solids into the flow of cleanout fluid for traversal upward through the annular area formed between the conduit and the extension member as well as between the conduit and the production fluid tube and out of the wellbore itself.

In accordance with another aspect of the present invention, there is provided a hydraulic jet type circulation and cleanout system for insertion in a wellbore including a production tube extension member and a nozzle assembly which is connected to the lower or distal end of a coiled tube or conduit. The coiled tube is insertable in the wellbore down to and through the end of the production fluid tube, the extension member is set in a working position by a latching mechanism and the nozzle assembly may be run on into the wellbore by separation of a frangible coupling between the extension member and the nozzle assembly. The nozzle assembly, in conjunction with the coiled tubing or similar conduit member, may then be retrieved along with the extension member by release of the extension member latching mechanism through a pullout or withdrawal force exerted on the extension member by the nozzle assembly itself.

The present invention further contemplates an improved method of performing wellbore cleanout operations, including the steps of determining the distance between the lower end of a production fluid tube which is in the wellbore and a gravel pack liner hanger or similar wellbore device, insertion of a production tube extension member into the wellbore to minimize the distance between the lower end of a flow passage formed by the extension member and the production fluid tube and an area to be washed free of collected solids or sediments, and insertion of the extension member and a conduit for conducting well cleanout fluid into the wellbore. The improved method also provides for setting the extension member at the lower end of a fluid conducting tube, extension of the nozzle and fluid conduit further into the wellbore, pumping well cleanout fluid into the wellbore through the conduit and nozzle assembly to wash accumulated solids and sediments up through the annular flow passage formed within the extension member and the production fluid conduit, and withdrawal of the extension member and the cleanout fluid conduit from the wellbore through the production fluid tube.

The abovementioned advantages and superior features of the present invention together with other aspects of the inventive apparatus and method will be further appreciated by those skilled in the art upon reading the detailed description which follows, in conjunction with the drawing.

DESCRIPTION OF THE PREFERRED EMBODIMENTS

Figure 1:
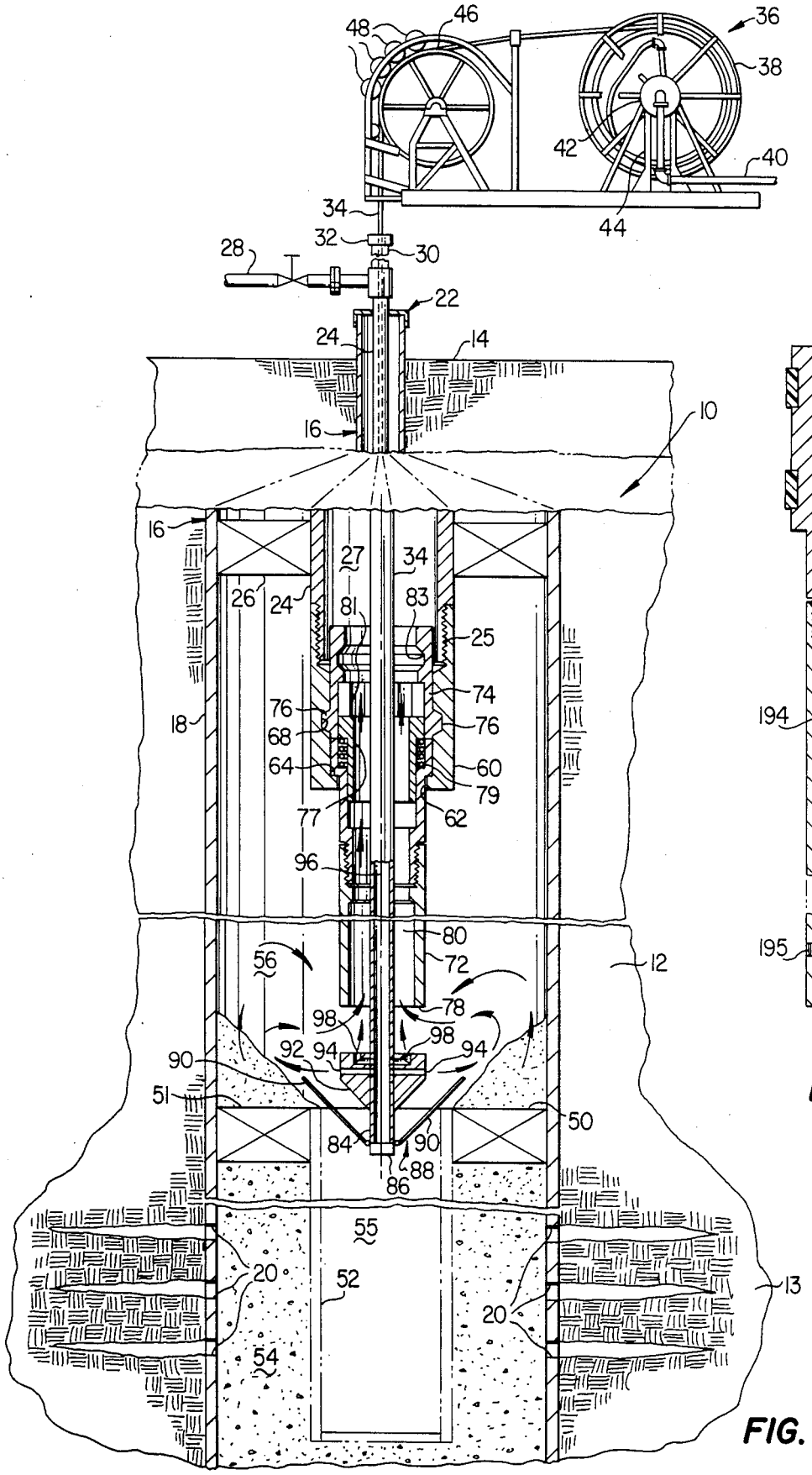
FIG. 1 is a vertical section view, in generally schematic form, of a subterranean well including a wellbore cleanout system in accordance with the present invention.

In the description which follows, like parts are marked throughout the specification and drawing with the same reference numerals, respectively. The drawing figures are not necessarily to scale and the scale of certain elements in a drawing figure may change in that figure. Certain features of the invention may be shown in somewhat schematic form and conventional elements may be referred to in general in the interest of clarity and conciseness.

Referring to FIG. 1 there is illustrated a well, generally designated by the numeral 10, which has been drilled into a subterranean formation 12 for the production of fluids or slurrylike substances from the formation to the earth's surface 14. The well 10 has been completed with a conventional casing structure 16, including a bottom hole casing section 18 which has been perforated at suitable spaced apart perforations 20 to permit fluid to flow into the interior of the casing from the formation 12. The well 10 has been complete with a conventional wellhead 22 and a string of production fluid tubing 24 is suspended from the wellhead into the interior of the well to a generally predetermined depth and extending through a packer 26. The tubing 24 is adapted to conduct well fluids from the well 10 to a surface flow line 28 by way of the wellhead 22.

The wellhead 22 has also been provided with a conventional wireline lubricator device 30 and a stuffing box 32 adapted to receive a string of coiled tubing 34 which may extend through the wellhead 22 and generally concentrically within the tubing string 24. The coiled tubing 34 may be traversed into and out of the well 10 and through the tubing string 24 by way of a coiled tubing injection unit, generally designated by the numeral 36. The injection unit 36 may be one of several types commercially available and, by way of example, includes a storage reel 38 adapted to store a substantial length of tubing 34 in a coiled condition thereon and connected at one end to a fluid conduit means 40 which includes a swivel connection 42 between the reel support structure 44 and the reel 38. The swivel connection 42 may be of conventional construction and a detailed description thereof together with other details of the tubing injection unit 36 are not believed to be necessary to practice the present invention. The tubing injection unit 36 includes a power wheel 46 over which the tubing 34 is trained and biased into engagement therewith by a set of guide rollers 48 whereby the tubing 34 may be traversed on and off the reel 38 and straightened for injection into the wellbore through the wellhead 22 and the stuffing box 32.

Referring further to FIG. 1, the well 10 has been completed by the installation of a conventional casing liner hanger 50 which has been set at a predetermined point within the casing section 18 and has connected thereto an elongated perforated liner or gravel pack screen 52. The liner 52 extends into a production zone 13 of the formation 12 and is preferably surrounded by a quantity of gravel 54 acting as a filter medium for filtering solid particles and sediment out of the fluids which flow into the wellbore from the formation 12. The presence of the gravel 54 is intended to prevent the interruption of production fluid flow due to entrainment of relatively large solid particles in the fluid entering the wellbore. However, the perforations or openings in the liner or screen 52 tend to become clogged with solid particles. Moreover, particles enter the flow passage 55 within the liner 52 as well as the wellbore space 56 above the hanger 50 and tend to accumulate in the bottom of the liner 52 as well as in a generally annular space formed above the hanger 50. Excessive accumulation of solids in these spaces can interfere with the flow of production fluids as well as interfere in the setting or removal of the liner 52 and the hanger 50. Accordingly, it is important to be able to clean the perforations in the liner 52 as well as be sure that the flow path formed by the passage 55 is substantially free of any accumulations of sediment or solids. It is also desireable to minimize the accumulation of solids in the space 56 between the lower end 25 of the tubing string 24 and the flow path 27 formed in the tubing string 24.

In accordance with this invention, the lower end 25 of the tubing string 24 is provided with a tubing section or nipple 60, commonly referred to as a no-go nipple, which is preferably formed to have a reduced diameter portion 62 forming a bore which opens into the space 56. The reduced diameter portion 62 forms a transverse shoulder 64. The nipple 60 is also provided with a suitable annular recess 68 for the receipt of latching dogs or other retaining means for retaining a member which may be extended through the tubing string 24 and engaged with the nipple 60. The exact location of the lower end 25 of the tubing string 24, even if it includes the nipple 60, may be somewhat indeterminate relative to the position of the liner hanger 50. Accordingly, the space 56 may be sufficiently large such that the flow of the production fluids from the passage 55 into the space 56 may be reduced in velocity whereby entrained solid particles may settle out in the space 56 and accumulate on the top surface 51, for example, of the liner hanger 50 or tend to fall back into the passage 55 and restrict the flow of fluids therethrough. Taking into consideration that the producing zone 13 of formation 12 may be several thousand feet below the surface 14 it can be appreciated the difficulty which arises in trying to initially set the exact position of the lower end of the tubing string 24. Notwithstanding the problems associated with the accumulation of debris within the flow passage 55 and the space 56, as mentioned previously, the openings or perforations in the liner or screen 52 may tend to become clogged from time to time and require some type of reverse flow or fluid jetting action to free these perforations of accumulations of packed solid particles.

In accordance with the present invention, it is proposed to provide an improved flow passage for removal of solid particles such as sand and other sediments which block the flow fluid through the gravel pack liner, migrate into the interior of the liner 52 and also accumulate in the space 56 by using a fluid which may be pumped down into the wellbore through the coiled tube 34 after insertion of the tube 34 together with a modified end structure thereon into the wellbore through the production tubing string 24. Referring further to FIG. 1, the present invention includes the provision of a generally tubular extension member 72 which is slightly smaller in diameter than the interior flow passage 27 formed by the tubing sring 24 and may be traversed through the tubing string. The extension tube 72 includes a landing mandrel 74 connected to or formed as a part of the upper end of the extension tube. The landing mandrel 74 is provided with suitable integral or cantilever type latching dogs or catches 76 which are adapted to deflect or extend radially outwardly into the recess 68 for locking the mandrel and the extension tube in the position illustrated in FIG. 1. The catches 76 are held in engagement with the nipple 60 by a piston 77 slidably disposed in the position shown in FIG. 1 by a coil spring 79 so as to prevent radial inward displacement of the catches 76. The piston 77 includes a traverse face 81 which may be engaged by suitable wireline setting tool means, not shown, or acted on by pressure fluid to move the piston downward, viewing FIG. 1, to a position that the catches 76 may be moved radially inward in response to an axial force on the mandrel to allow the mandrel to seat in the nipple 60 or to release it from the nipple 60. The upper end of the mandrel 74 may include a profiled recess 83 for receiving the abovementioned wireline setting tool means.

The required length of the extension tube 72 may be predetermined using a borehole televiewing device, for example, or other similar means to measure the distance from the distal end of the nipple 60 to the surface 51. The lower open end 78 of the tube 72 is disposed, in the assembled position illustrated, above the surface 51 a distance preferably between one-half and one times the diameter of the casing section 18. The diameter of the extension tube 72 is also selected such that a flow passage 80 is formed having a cross-sectional area as large as possible and preferably not less than the cross-sectional flow area of the coiled tube 34 itself.

The lower end of the coiled tube 34, which is designated generally by the numeral 84, is closed by a plug 86 and is also fitted with a suitable centralizing device 88. The centralizing device 88 may comprise opposed radially extending spring wires 90 which are suitably anchored at their radially innermost ends and are deflectable so that they may pass through the bore of the tubes 24 and 72 but are of sufficient stiffness as to provide for guiding the lower end of the tube 34 into the passage 55, for example.

The lower end of the tube 34 is also provided with a jet nozzle head 92 suitably secured thereon or formed as part of a head assembly which is secured to the lower end of the tube and may include the centralizing device 88. The nozzle head 92 is provided with a plurality of radially directed jet nozzle orifices 94 which may be offset with respect to the central longitudinal axis 96 of the tube 34 to impart a swirling or cyclonic action to the fluid in the space 56, if desired. The nozzle head 92 also includes one or more axially directed nozzle orifices 98 which are located such as to provide a jet ejector or eductor effect into the passage 80 from the space 56 depending on the position of the nozzle head relative to the distal end of the extension tube 72. In any case, the nozzle orifices 98 are operable to cause a vertical upward flow of fluid in the space 56 or in the passage 55 if the nozzle head 92 has been lowered thereinto in accordance with the present invention.

Thanks to the arrangement of the nozzle head 92 on the lower end of the coiled tube 34, and the provision of the extension tube 72 having a lower end which is predetermined to be closer to the upper end of the liner hanger 50 than can be expected for the production tube string 24, hydraulic fluid may be pumped down through the coiled tube 34 and jetted out through the nozzles 94 and 98 to entrain solid particles into the jetted fluid for evacuation from the wellbore up through the passages 80 and 27 and to be conducted away from the well through the flowline 28.

When it has been determined that a significant accumulation of solids has taken place in the wellbore such as by clogging the perforations in the liner or screen 52, accumulation of material in the passage 55 and/or accumulation of solid material in the space 56 and particularly as built up from the surface 51, a cleanout operation is carried out by first determining the distance between the surface 51 and the lower end of the production tube string 24. This distance may be measured using a suitable logging tool or image producing tool which is capable of generating signals indicating the location of the surface 51 relative to the lower end of the nipple 60. Accordingly, an extension tube 72 is selected which is of sufficient length when landed and locked in engagement with the nipple 60 such that the extension tube lower end 78 is the preferred predetermined distance above the surface 51.

The extension tube 72 is then prepared for installation in the production tubing string 24 by, for example, insertion of the assembly of the mandrel 74 and the extension tube 72 into the lubricator 30, followed by extension of the coiled tube 34 through the extension tube 72 and then installation of the nozzle head 92 and the centralizer device 88 on the lower distal end of the coiled tube 34. The assembly of the extension tube 72, mandrel 74 and nozzle head 92 are run down on the tube 34 until the extension tube is located in the bore 62. Fluid may be pumped down the tubing 24 to act on piston face 81 to move the piston 77 to allow the catches 76 to move radially inward and then seat in the recess 68. Alternatively, if the diameter of the head 92 is not larger than the smallest bore portion forming the passage 80, the extension tube 72 may be installed before the coiled tube 34 is run into the wellbore through the tubing string 24. The extension tube 72 may be pumped down or lowered with a wireline setting tool, not shown, unti the landing mandrel 74 engages the nipple 60 and the latching dogs or catches 76 are suitably locked in the recesses 68.

The coilded tube 34 may then be lowered until the nozzle head 92 is clear of the lower end 78 of the tube extension tube 72 and a suitable fluid such as water then pumped down through the coiled tube 34 and jetted out through the nozzle orifices 94 and 98 to entrain solids which have deposited in the space 56 with sufficient velocity to carry the solids up through the passage 80 and the passage 27 formed by the tubing string 24. The nozzle head 92 may be lowered into the passage 55 to wash the liner 52 by backflushing the liner through its own perforations or mesh and by generating sufficient fluid circulation as to entrain any debris which has settled within the passage 55. The combined action of the jetted fluid emitting from the nozzle orifices 94 and 98 will create a relatively high velocity flow of fluid upward through the passage 55 and into the passage 80 formed by the extension tube 72. As the nozzle head 92 is withdrawn back up into the space 56, continued pumping of fluid through the nozzle orifices 94 and 98 will provide a second washing of the space 56, particularly at the lower regions thereof to prevent the accumulation or settling of solids on the surface 51, for example.

When the cleanout operation is completed the tube 34 may be withdrawn up through the tubing string 24 and, if the nozzle head 92 is of a diameter such that it will not pass through the bore of the extension tube or member 72, the extension tube may be suitably unlocked and retrieved with the tube 34 by way of several suitable procedures, including, if necessary, shearout of the latching dogs 76 upon exertion of a suitable upward force on the extension tube 72 through the tube 34 and the nozzle head 92. Accordingly, well cleanout operations may be carried out with improved performance and efficiency utilizing a relatively uncomplicated apparatus at the wellhead such as the coiled tubing injection unit 36 and by modifying the flow path provided in the wellbore through utilization of the extension tube member 72 and a hydraulic jet nozzle arrangement for conducting relatively high velocity flows of fluid in the passages 55 and the space 56 to evacuate accumulated solids in these locations.

Figure 2:
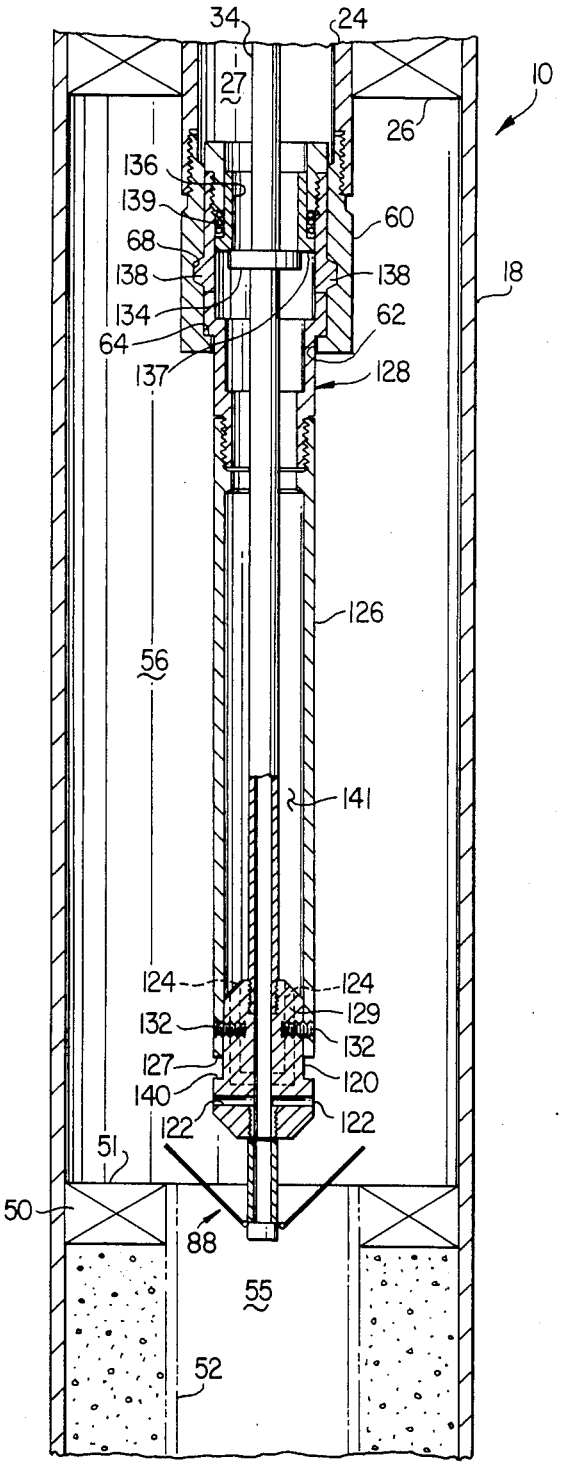
FIG. 2 is a partial vertical section view, a somewhat schematic form, of an alternate embodiment of the well cleanout system of the present invention.

Referring now to FIG. 2, an alternate embodiment of the present invention is illustrated in vertical central section and in somewhat schematic form. The arrangement illustrated in FIG. 2 includes the tubing string 24 and the nipple 60 together with a modified lower end arrangement of the coiled tube 34 including a nozzle head 120 which is formed with radially directed nozzle orifices 122 and vertically upward or longitudinally directed nozzle orifices 124. An extension tube 126 is illustrated locked into a working position in engagement with the nipple 60 and including a locking mandrel 128 having a configuration which is adapted to engage the transverse shoulder 64 of the nipple 60 to position the lower end 127 of the extension tube at a predetermined position in relation to the liner hanger 50. The extension tube 126 may be carried into the wellbore through the tubing string 24 connected to the nozzle head 120 by frangible coupling means including opposed shear screws 132 which extend through the lower end of the extension tube 126 and a hub portion 129 of the nozzle head 120.

A release ring 134 is secured on the tube 34 above the nozzle head 120 and is engageable with a suitable spring biased latch release piston 136 on the mandrel 128 for actuation to permit release or retraction of plural cantilever type catches or latching dogs 138 which are radially outwardly moveable into the recess 68 to engage the mandrel 128 with the nipple 60.

When the nozzle head 120 is secured to the lower end of the extension tube member 126 by the screws 132, the end 127 of the extension tube 126 is spaced from a transverse shoulder 140 formed on the nozzle head 120. This location of the nozzle head 120 and the release ring 134 in relation to the extension tube 126 is such that the extension tube 16 may be set in place in engagement with the nipple 60 by lowering the tube 34 secured to the nozzle head 120 until the landing mandrel 128 is suitably engaged with and locked in position with the nipple 60. For example, the nozzle head 120 and extension tube 126 may be lowered into the tubing string 24 in the relative positions to each other shown in FIG. 2. The position of the ring 134, when the nozzle head 120 is secured to the extension tube 126 is such as to hold the piston 136 in a position to permit radial inward flexing of the catches 138 as the mandrel 128 enters the nipple 60 to allow the catches to seat the recess 68 as the mandrel 128 seats itself in the nipple 60 against the shoulder 64. An axailly directed downward force may then be exerted on the tube 34 to effect shearing of the screws 132 so that the nozzle head 120 may be extended below the nozzle end 127 of the tube extension to open a passage 141 formed by the tube 126 to the space 56. As the ring 134 moves downward with the tube 34 the piston 136 moves into a positon to prevent radial inward displacement of the catches 138. The nozzle head 120 together with the tube 34 may then be raised and lowered relative to the extension member 126 while pumping fluid such as water through the tube 34 and out through the nozzle orifices 122 and 124 to perform the hydraulic agitation and cleanout operation described previously for the embodiment illustrated in FIG. 1.

When it is desired to remove the tube 34 and the extension tube 126 from the tubing string 24, the tubing 34 is pulled upward until the release ring 134 engages and moves the piston 136 upward to clear the catches 138, which action occurs prior to engagement of the shoulder 140 with the lower end 127 of the extension tube. The extension tube 126, mandrel 138 and the nozzle head 120, together with the coiled tube 34, may then be released from the nipple 60, as the catches 138 move radially inward, and removed from the wellbore upward through the tubing string 24 until the extension tube is returned to the lubricator 30, shown in FIG. 1.

Figure 3:
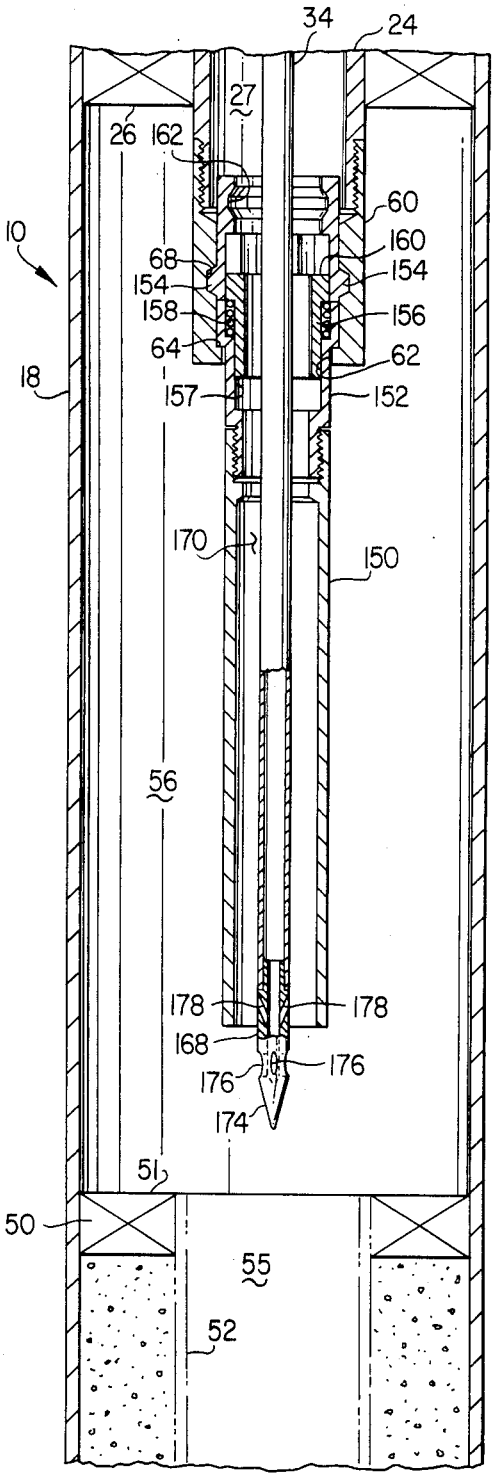
FIG. 3 is a vertical section view, in somewhat schematic form, of a second alternate embodiment of a well cleanout system in accordance with the present invention.

FIG. 3 illustrates another embodiment of the present invention wherein an extension tube member 150 is provided with a landing mandrel 152 similar to the landing mandrel 74 which may be set and locked in engagement with the nipple 60 by lowering the mandrel 152 in assembly with the extension tube member 150 using conventional wireline setting tool means or similar lowering means. The mandrel 152 includes a plurality of circumferentially spaced radially inwardly deflectable fingerlike catches 154 which are engageable with the recess 68 to lock the mandrel in the position shown against the shoulder 64 on the nipple 60. A piston 156 is slideable within a bore 157 of the mandrel 152 and is biased into the position illustrated in FIG. 3 by a coil spring 158. The piston 156 includes a transverse face 160 which may be engaged by a suitable wireline setting tool, or the like, to move the piston axially downwardly, viewing FIG. 3, a sufficient distance to permit the fingers 154 to be deflected radially inwardly so that the mandrel 152 may be inserted in or removed from the nipple 60. A profiled recess 162 is also formed at the upper end of the mandrel 152 for engagement with the aforementioned wireline setting tool or a similar insertion device to provide for insertion of and removeable of the mandrel 152 with respect to the nipple 60. The aforedescribed arrangement of the mandrel 152 is virtually identical with the mandrel 74 and is not believed to require further description to enable one of ordinary skill in the art to practice the present invention. The mandrels 74 and 152, in particular, may have other configurations of spring biased latching dogs or catches, for example, which are adapted to automatically lock into the nipple 60 upon being lowered into the positions illustrated by suitable lowering tools known to those of various skill in the art of downhole oil and gas well equipment.

Upon retraction of the aforementioned wireline setting tool means, not shown, or other suitable lowering means from the tubing string 24, the coilable tube 34 is lowered into and through the tubing string 24. In the embodiment illustrated in FIG. 3 the tubing 34 is adapted to have nozzle head 168 secured to the lower end thereof and of a diameter sufficient to pass through the passage 170 formed by the mandrel 152 and the extension tube member 150. The nozzle head 168 preferably has somewhat blunt but conically shaped nose 174 to facilitate guidance of the nozzle head. A plurality of radially directed nozzle orifices 176 and generally upward axially directed orifices 178 are formed in the head 168 to provide the jetting action required for agitation and ejection of fluid through the passage 170 and the interior flow pasage 27 formed by the production tubing string 24. As with the embodiments described in conjunction with FIGS. 1 and 2, the tubing 34 may be lowered and raised to provide a washing action on the liner 52 and hanger 50 as fluid is pumped down through the tubing 34, out through the nozzle head 168 and through the passages 58, 170 and 27 to remove accumulated solids from the wellbore.

Figure 4:
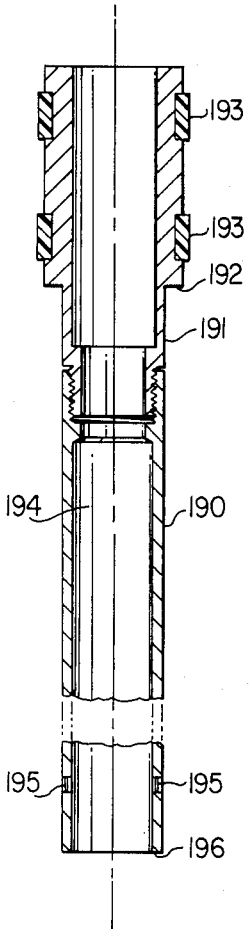
FIG. 4 is a central longitudinal section view of an alternate embodiment of an extension tube and mandrel.

Referring now to FIG. 4, another embodiment of the assembly of the extension tube member and landing mandrel is illustrated and is characterized by an extension tube member 190 similar to the extension tube members 72, 126 and 150. The extension tube 190 is threadably connected to a cylindrical landing mandrel 191, having a transverse shoulder 192 for engagement with the shoulder 64 of the nipple 60, for example. The mandrel 191 is provided with two spaced-apart cylindrical seal members 193 which are made of a suitable resilient material such as urethane or synthetic rubber and are adapted to forcibly engage the bore of the nipple with sufficient force to retain the mandrel in the nipple 60 in the same relative position as is provided by the catches on the mandrels 74 and 128, or example. The assembly of the extension tube 190 and the mandrel 191 defines a longitudinal flow passage 194 for conducting pressure fluid and entrained solids upward into the passage 27 when the assembly of the extension tube 190 and the mandrel 191 is inserted in the production tubing string 24 in place of the embodiments described in conjunction with FIGS. 1 through 3.

The extension tube member 190 and mandrel 191 may be run in assembly with the nozzle head 120 into the production tubing string 24 on the distal end of the tubing 34. In this regard, the lower end of the extension tube 190 is provided with opposed threaded holes 195 for receiving the shear screws 132 for connecting the extension tube 190 to the nozzle head when it is run into the well. Accordingly, the extension tube member 190 in assembly with the mandrel 191 may be run into a position in the nipple 60 and frictionally engaged therewith by the seals 193 followed by decoupling the nozzle head 120 from the extension tube 190 to perform the aforementioned cleanout operation. When it is desired to remove the nozzle head and the extension tube member 190, the head is retracted upward until it engages the distal end 196 of the extension tube member so that this member may be removed from the tubing string 24 as the coiled tubing 34 is pulled out of the passage 27.

It will be appreciated from the foregoing description that an improved apparatus and method have been provided for cleaning out wellbores which have undergone unwanted accumulations of solids materials in areas which may restrict the flow of production fluids from the wellbores or may interfere with installation or removal of various wellbore apparatus. Although preferred embodiments of the apparatus of the invention have been described, together with preferred embodiments of a method of cleaning out a wellbore, those skilled in the art will recognize that various substitutions and modifications may be made to the arrangements described herein without departing from the scope and spirit of the invention as recited in the appended claims.

What I claim is:

1. A method for performing well cleanout operations in a subterranean well to remove accumulations of solid particles wherein said well includes means forming a flow passage in communication with a fluid producing zone and support means for supporting said means forming said flow passage and said well includes an elongated production tube extending into said well and forming a conduit for conducting produced fluid and fluid introduced into said well to the surface, said cleanout method comprising the steps of:

determining the location of a lower end of said production tube in relation to accumulations of solid particles in said well, including said passage;

providing an extension tube member for insertion into said production tube and movement to the lower end of said production tube for effectively extending the length of said production tube into an area containing said accumulation of solids;

providing a length of coilable tubing for extension through said production tube and providing nozzle means connected to said coilable tubing at a distal end thereof for insertion through said production tube and into said passage;

positioning said extension tube member at the lower end of said production tube to effectively extend the length of said production tube;

extending said coilable tubing and said nozzle means into said well through said production tube into the vicinity accumulations of said solid particles; and pumping fluid through said coilable tubing and said nozzle means to entrain accumulated solids in said passage for evacuation from said well through said extension tube member and said production tube to clean said well in the vicinity of said producing formation.

2. The method set forth in claim 1 wherein:

the step of extending said extension tube member and said coilable tubing into said well is carried out simultaneously.

3. The method set forth in claim 1 including the step of:

positioning said extension tube member at the lower end of said production tube by moving said extension tube member through said production tube with said coilable tubing connected to said extension tube member.

4. The method set forth in claim 1 including the step of:

extending said nozzle means and said coilable tubing into said well substantially below a distal end of said extension tube member while pumping fluid through said coilable tubing to wash said means forming said passage substantially free of accumulations of said solid particles; and retracting said coilable tubing and said extension tube member out of said well through said production tube.

5. A well cleanout system for removing accumulations of solid particles in a fluid producing well wherein fluid produced by said well tends to deposit accumulations of solid particles over a period of time in passage means formed in the wellbore and wherein said well includes a production fluid conduit extending thereinto in the vicinity of a fluid producing zone but spaced therefrom sufficiently to reduce the vicinity of fluid entering the wellbore from said fluid producing zone, said system comprising:

a generally tubular extension member insertable into said prduction fluid conduit and including means engageable with cooperating means on said production fluid conduit at a lower end thereof to effectively extend the length of said production fluid conduit into a portion of a space in said wellbore where accumulations of solid particles have occurred;

an elongated tube of a diameter such that said tube may be extended through said production fluid conduit and said extension member and into said passage means below the distal end of said extension member;

jet nozzle means operably connected to said tube and extendable into said passage means for jetting quantities of circulation fluid into said wellbore to entrain accumulated particles in said wellbore into a fluid flow stream of said circulation fluid for movement upward and out of said wellbore through said extension member and said production fluid conduit; and means forming a frangible connection between said nozzle means and said extension member for conveying said extension member through said production fluid conduit by traversing said nozzle means and said tube through said production fluid conduit for engagement with means for retaining said extension member at the distal end of said production fluid conduit, said means forming said frangible connection being operable to permit further extension of said nozzle means and said tube into said passage means upon securing said extension member in said production fluid conduit.

6. The system set forth in claim 5 including:

means on said tube and cooperable with means on said extension member for effecting release of said extension member from said production fluid conduit upon pulling said nozzle means upward through said wellbore.

7. The system set forth in claim 5 wherein:

said extension member includes radially extendable catch means engageable with cooperating means on said production fluid conduit for securing said extension member to said production fluid conduit.

8. The system set forth in claim 5 wherein:

said extension member includes resilient seal means adapted to be engageable with means on said production fluid conduit for securing said extension member in said production fluid conduit at the distal end thereof.

9. A well cleanout system for removing accumulations of solid particles in a fluid producing well wherein fluid produced by said well tends to deposit accumulations of solid particles over a period of time in passage means formed in the wellbore and wherein said well includes a production fluid conduit extending thereinto in the vicinity of a fluid producing zone but spaced therefrom sufficiently to reduce the velocity of fluid entering the wellbore from said fluid producing zone, said system comprising:

a generally tubular extension member defining a passage and being insertable into said production fluid conduit, said extension member including means engageable with cooperating means on said production fluid conduit at a lower end thereof to effectively extend the length of said production fluid conduit into a portion of a space in said wellbore where accumulations of solid particles have occurred;

an elongated substantially stiff tube of a diameter such that said tube may be extended through said production fluid conduit and said extension member and into said passage means below the distal end of said extension member; and jet nozzle means operably connected to said tube and extendable into said passage means, said nozzle means including a nozzle head connected to said tube and including at least one radially directed nozzle orifice for jetting circulation fluid into said wellbore to entrain accumulated particles in said wellbore into a fluid flow stream of said circulation fluid and at least one axially directed nozzle orifice operable to jet circulation fluid from said nozzle head toward said passage in said extension member for entraining said flow stream of circulation fluid and particles for movement upward and out of said wellbore through said extension member and said production fluid conduit.

10. The system set forth in claim 9 including:

centralizing means connected to said tube for guiding said tube and said nozzle means into and through passage means formed in said wellbore.

11. A well cleanout system for removing accumulations of solid particles in a fluid producing well wherein fluid produced by said well tends to deposit accumulations of solid particles over a period of time in passage means formed in the wellbore and wherein said well includes a production fluid conduit extending thereinto in the vicinity of a fluid producing zone but spaced therefrom sufficiently to reduce the velocity of fluid entering the wellbore from said fluid producing zone, said system comprising:

a generally tubular extension member insertable into said production fluid conduit and including means engageable with cooperating means on said production fluid conduit at a lower end thereof to effectively extend the length of said production fluid conduit into a portion of space in said wellbore where accumulations of solid particles have occurred;

an elongated tube of a diameter such that said tube may be extended through said producton fluid conduit and said extension member and into said passage means below the distal end of said extension member;

jet nozzle means operably connected to said tube and extendable into said passage means for jetting quantities of circulation fluid into said wellbore to entrain accumulated particles in said wellbore into a fluid flow stream of said circulation fluid for movement upward and out of said wellbore through said extension member and said production fluid conduit; and means forming a releasable connection between said nozzle means and said extension member for conveying said extension member through said production fluid conduit by traversing said nozzle means and said tube through said production fluid conduit for engagement with means for retaining said extension member at the distal end of said production fluid conduit, said means forming said releasable connection being operable to permit further extension of said nozzle means and said tube into said passage means upon securing said extension member in said production fluid conduit.

* * * * *

UNITED STATES PATENT OFFICE

CERTIFICATE OF CORRECTION

PATENT NO. : 4,671,359

DATED : June 9, 1987

INVENTOR(S) : Jimmie J. Renfro

It is certified that error appears in the above-identified patent and that said Letters Patent are hereby corrected as shown below:

On the next to the last page, Column 11, line 15, "vicinity" should read --velocity--.

On the next to the last page, Column 11, line 19, "prduction" should read --production---.

Signed and Sealed this

Twenty-seventh Day of October, 1987

*Attest:*

DONALD J. QUIGG

*Attesting Officer*

*Commissioner of Patents and Trademarks*